United States Patent [19]

Rowe

[11] 3,973,495

[45] Aug. 10, 1976

[54] HAND STAMP

[75] Inventor: Archie C. Rowe, Melbourne, Australia

[73] Assignee: Vuestamp International Proprietary Limited, Keswick, Australia

[22] Filed: Feb. 28, 1973

[21] Appl No.: 336,506

Related U.S. Application Data

[63] Continuation-in-part of Ser. No. 102,019, Dec. 28, 1970, abandoned.

[30] Foreign Application Priority Data

July 31, 1970 Australia ..... 2044/70

[52] U.S. Cl. ..... 101/405; 118/264

[51] Int. Cl.[2] ..... B41K 1/56

[58] Field of Search ..... 101/405, 368, 401.1; 118/264

[56] References Cited

UNITED STATES PATENTS

| | | | |
|---|---|---|---|
| 1,038,219 | 9/1912 | Smith | 101/405 |
| 1,420,376 | 6/1922 | Hellesoe | 101/405 X |
| 1,788,681 | 1/1931 | Melind | 101/405 X |
| 2,176,160 | 10/1939 | Uhl, Jr. | 101/405 X |
| 2,195,994 | 4/1940 | Morse | 101/405 |
| 2,480,686 | 8/1949 | Aigner | 101/405 X |
| 2,899,895 | 8/1959 | Tannery | 101/405 X |
| 2,966,116 | 12/1960 | Harris et al. | 101/405 X |
| 3,096,713 | 7/1963 | McLaughlin, Jr. | 101/405 X |
| 3,128,700 | 4/1964 | Kunetka | 101/401.1 X |
| 3,315,601 | 4/1967 | Borack | 101/405 X |

FOREIGN PATENTS OR APPLICATIONS

| | | | |
|---|---|---|---|
| 403,092 | 2/1968 | Australia | 101/405 |
| 1,560,974 | 3/1969 | France | 101/405 |

*Primary Examiner*—E. H. Eickholt
*Attorney, Agent, or Firm*—Oldham & Oldham Co.

[57] ABSTRACT

A hand stamp comprising a transparent base through which a proof of the impression in substantial registration therewith is visable to the user. Individual handwork is eliminated by provision of selected stock size bases and a snap over channel which carries the impression.

4 Claims, 2 Drawing Figures

HAND STAMP

The present application is a continuation-in-part of my prior application Ser. No. 102,019, filed Dec. 28, 1970 now abandoned.

This invention relates to improvements in the manufacture of hand stamps of the kind generally referred to as "rubber stamps."

Rubber stamps are conventionally so called because the pattern bearing surface is usually made of rubber. In this specification, the term "hand stamp" will be used to include both conventional rubber stamps and also stamps in which the pattern bearing surface is composed of suitable material other than rubber.

The techniques employed in the rubber stamp manufacturing industry have altered very little in the past 100 years. The typical rubber stamp is a wooden mounted stamp, consisting of a turned wooden handle fitted into a wooden base, with a pin or identifying mark on one side of the stamp to identify the front from the back.

The wooden mounted stamps are manufactured broadly as follows. A stock of different sized turned wooden handles are kept, together with a stock of prepainted wood moldings or varying widths to be used for the base sections. When a stamp is to be made, the actual rubber mold for a particular stamp is cut out from the molded sheet, and, based on its width, the width of molding for the base is selected. The length of the rubber mold is marked on the piece of base molding which is subsequently sawed off and sanded on either end.

The appropriate sized handle to match the base molding is then selected, a hole exactly matching the male end of the handle is drilled into the piece of base timber, and the male end of the handle is then glued and pressed or hammered into the base very firmly. The rubber mold is then glued onto the base, and after this an indicating pin is hammered into the base. Both ends of the base are then normally painted also with matching paint, to hide the saw marks.

It has hitherto been firmly believed and forcibly argued throughout the trade that the foregoing individual handwork was unavoidable, especially in regard to custom-made stamps. However, as a result of an exhaustive survey and analysis carried out by the present inventor, it has been found that, contrary to these beliefs, almost the entire production of stamps can be classified to fit on about forty stock size bases, with only an acceptably small margin left between the edge of the rubber mold and the edge of its nearest sized stock base. This eliminates the separate action for each stamp of marking and sawing and sanding molding lengths, and the individual painting of both ends. Thus, in accordance with one aspect of the present invention, stock sized bases, center drilled and with finished ends, can be provided from wood or other materials, including those hereinafter described.

Handles can also be fitted, enabling the marketing of complete stock size mounts.

The forty stock sizes selected are as follows:

⅜ × ½ inch, ⅜ × 1 inch, ⅜ × 1½ inch, ⅜ × 2 inches ⅜ × 2½ inches, ⅜ × 3 inches, ⅜ × 3½ inches, ⅜ × 4 inches;

⅝ × ¾ inch, ⅝ × 1½ inches, ⅝ × 2 inches, ⅝ × 2½ , ⅝ × 3 inches, ⅝ × 3½ inches, ⅝ × 4 inches;

13/16 inch × 13/16, 1½ inches, 2 inches, 2½ inches, 3 inches, 3½ inches, 4 inches;

1 × 1 inch, 1 × 1½ inches, 1 × 2 inches, 1 × 2½ inches, 1 × 3 inches, 1 × 3½ inches, 1 × 4 inches;

1¼ × 3 inches, 1¼ × 4 inches 1¼ × 5 inches;

1½ × 2¼ inches, 1½ × 2¾ inches, 1½ × 3¼ inches, 1½ × 4 inches;

1¾ × 1¾;

2 × 2¼ inches, 2 × 3 inches 2½ × 4 inches;

As will be appreciated by persons skilled in the art, the above sizes are subject to appropriate tolerances.

Of course, NOT EVERY stamp made will fit on a stock size, but the overwhelming majority do, thus achieving very substantial economies, and the minute percentage left can be handled in another way.

In accordance with a further aspect of the invention, the handles may be manufactured from polypropylene, G.P. Styrene, polythene, acetate, ABS. butyrates and the like and the stock sized bases from a thermoplastic material by a process of plastic molding, either as a one-piece mold, or separately and subsequently joined together. When produced "en masse" either method is much cheaper, quicker and more efficient than either of the normal production methods hereinabove described for affixing handles to bases on conventional stamps. Alternatively, the plastic base is extruded in standard widths, cut to predetermined stock lengths (matching the stock base sized) and drilled with holes to match the handle shanks. Bases manufactured from these types of material are comparatively inexpensive, can be quite satisfactorily transparent if transparency is desired, and are not liable to accidental breakage. Furthermore, a much more aesthetically pleasing product is obtained, especially when using the molded stock handles and bases.

According to yet another aspect of the invention, a stamp may be provided in which the legend or wording of the stamp is visable to the user through a transparent base at the time the stamp is actually being used. This greatly facilitates speedy identification of each stamp, saving time and eliminating the usage of wrong stamps. It also enables accurate positioning of the impression on the paper, which, as is well known, is extremely difficult with conventional rubber stamps. Furthermore, as the actual wording is visable to the user at the moment of application to the paper, this should also virtually eliminate the error of applying a stamp upside-down.

A further embodiment of this aspect of the invention permits employment of a conventional rubber mold while retaining the advantages of the transparent base.

This is achieved by use of a transparent base, suitably of thermoplastic material, to which is laminated a sheet of paper, on which the wording of the stamp has been proofed from the type actually set up to manufacture the stamp. To this paper is adhered the actual rubber mold of the stamp, care being taken to ensure that the mold is substantially in registration with the wording on the paper.

A preferred embodiment of this invention has a square or rectangular transparent base with chamfered longitudinal edges. An extruded channel-like section of plastic material with the sides inclined inwardly corresponding to the slant of the sides of the base is slid or snapped over the base. The impression is secured to the underside of the channel preferably by a double sided adhesive strip.

The above invention will be better understood by an illustration of a preferred embodiment which is illustrated by way of example and not limitation in the accompanying drawings wherein.

Figure 1:
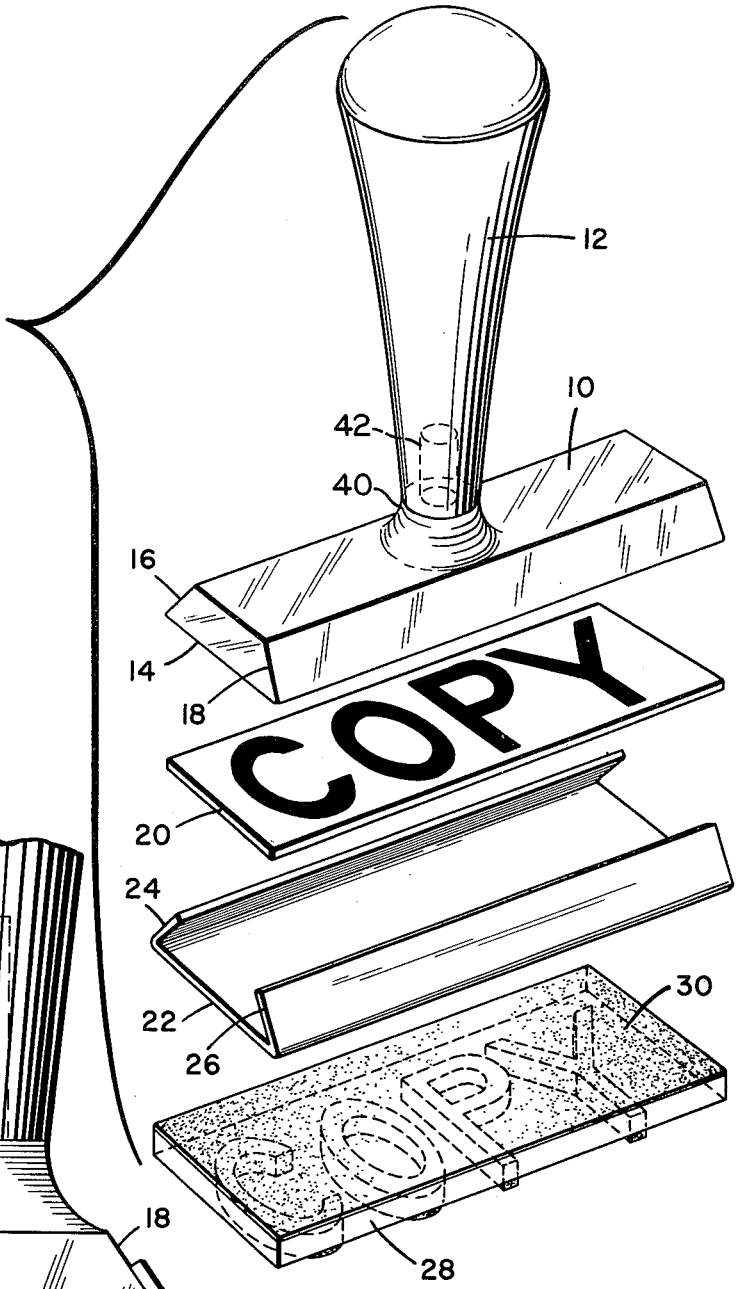
FIG. 1 is an exploded perspective view.
Figure 2:
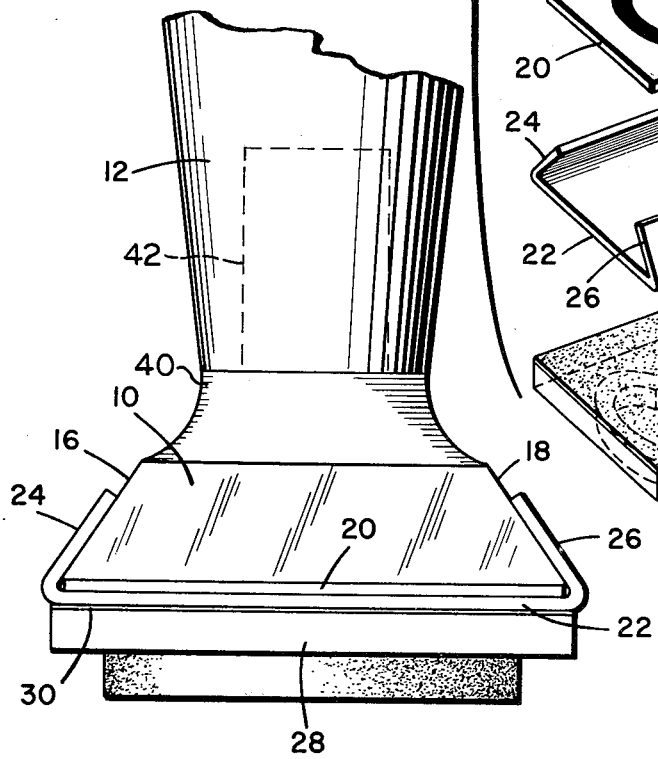
FIG. 2 is a side elevational view partly broken away of the assembled stamp of FIG. 1.

In FIG. 1, a transparent base member 10 is secured to an appropriately sized handle 12. This base has a flat bottom surface 14 and chamfered edges 16 and 18 which lie at an angle of about 75° to 85°, and preferably about 75°, to the flat surface 14. Immediately below the base member is a proof plate 20 which consists of a piece of paper or card cut to the size of the bottom 14 and bearing a copy of the impression which will be carried by the stamp. Preferably, the impression is placed on the proof plate in exactly the position that the impression will be in relation to the entire stamp so that when properly assembled the proof will be in registration with the impression so that it is possible to know the exact alignment when the impression is made on a surface which is desired to be marked. Immediately below the proof plate 20 is a channel section member 22 having turned up sides 24 and 26 at an angle which approximately corresponds to the angles of the chamfered edges 16 and 18 respectively. The channel shaped member is preferably made of a plastic material having sufficient elasticity and resilience so that it can be snapped over the base 14 by hooking one edge, say edge 24, over the base and then springing edge 26 out far enough so that it will snap over the opposite side of the base 10. Although such an interfit could also be accomplished by a sliding movement, it has been found that the snap-over fit is more desirable since it is faster to assemble, there is less likelihood of the proof plate getting out of alignment and it results in a tighter fit than one which has been slid on. With some types of plastics it may be desirable to have the angle of the sides 24 and 26 slightly greater than the angle of the base edges 16 and 18 in order to obtain a tighter grip on the base. One of the most suitable plastics for this channel section is ABS.

Below the channel 22 is the impression block 28 bearing the desired impression such as the word "COPY" as illustrated. This may be made of any of the materials previously described but is usually of molded sheet rubber or the like and may be adhered to the base of the channel section in any suitable way. One method of securement which lends itself to mass production techniques is use of a double sided pressure sensitive adhesive strip 30. This strip can be applied to the bottom of the channel section in the process of producing the channel with a temporary covering remaining over the outwardly facing portion of the adhesive strip until the legend is ready. The covering on the outer face is then removed and the legend molding easily attached to it by pressing. If there are any remaining exposed parts of the adhesive strip which would be stickly and subject to attracting dirt or dust, they can be covered with a talc material such as French chalk.

When snapping the member 22 onto the base 10, the resiliency of the edge flanges 24 and 26 permits engagement of the member 22 with the base by motion on an axis which is substantially or directly perpendicular to the flat surface of the base 10. By such direct snapping on movement of the member 22, then a substantial, if not exact alignment, of the facsimile or imprint from the impression block 28 can be retained in accurate register with the block as positioned in the stamp.

Also, the handle 12 is detachably secured to the base 10 by a spigot 40 or equivalent formed integrally with the base 10 and extending upwardly therefrom. Such spigot has a cylindrical upper portion that is frictionally received in a suitable complementary shaped socket or recess 42 provided in the lower end of the handle 12. Hence, a continuous unbroken surface is provided on the lower surface of the base 10 and a flat resilient engagement can be obtained between the base 10, the imprint 20, the channel member 22 and any means carried thereby so that an effective, uniform stamping action can be obtained by the stamp.

In some instances, it may be desirable to apply an impression, or form a facsimile, of the printing member 28 on the upper surface of the member 22 so that no independent imprint sheet 20 may be needed.

The detachable form of the channel member as described has the additional advantage that the impression block and channel member may be simply replaced when worn or a different legend is needed simply by discarding it and fitting the new legend and channel to the existing base and handle. A fresh proof plate would also be made at the same time.

In the method according to this invention an economical rubber stamp can readily be assembled by securing a handle to a base member which is formed with chamfered sides, forming an impression block and securing it to a channel shaped member which has inwardly turned edges which approximately correspond to the angle of the sides of the base member and then sliding or snapping the channel shaped member over the base of the stamp.

While one complete embodiment of the invention has been disclosed herein, it will be appreciated that modification of this particular embodiment of the invention may be resorted to without departing from the scope of the invention.

What is claimed is:

1. A hand stamp including a handle and comprising:

a transparent quadrilateral base secured to and protruding laterally from the handle and having at least a pair of opposed edges with portions slanting inwardly in an upward direction and a bottom surface, a channel shaped member fitted over said bottom surface, shaped to conform to said base, and detachably held in place by at least a pair of opposed sides having portions which are inwardly slanted complementary to said edge portions and engage the same to define a display space between the bottom surface of the base and interior of the channel shaped member, an impression block secured to the outer surface of the channel shaped member and usually planar when said channel shaped member engages said base, said display space being viewable through said transparent base to hold a proof plate bearing an imprint of said impression block in substantial registration with said impression block, the channel shaped member being formed from a resilient material so that such member can be snapped over said opposed edges of the base to be engaged therewith by said sides.

2. A hand stamp as in claim 1 wherein the base opposed edge portions extend downwardly and outwardly of the base, said bottom surface is flat, and the channel-shaped member side portions resiliently engage the opposed edges of the base to urge the member resiliently into engagement with the base and into full planar registration with the bottom thereof.

3. A hand stamp comprising a transparent base, a handle secured to said base and extending upwardly therefrom, said base having an unbroken flat bottom surface, a member including opposed portions by which the member can be detachably held to the transparent base, an impression block secured to an underneath face of the member, and a proof plate adapted to bear a facsimile of said impression block retained in place between the base and the member, in a viewable position and in substantial registration with the impression block, by the detachable member; and said member, said impression block and said proof plate include flat abutting surfaces whereby a firm support is provided therefor by said base; the member opposed portions engaging the base including a pair of opposed portions that are resilient and are slanted complementary in shape to downwardly and outwardly slanted opposed edge portions formed on the base, said impression member normally being planar when engaged with the base, the member and the proof plate being engageable as a unit with the base by a snap action forcing the complementary portions into engagement.

4. A hand stamp comprising a transparent base and an impression member including side portions to engage said transparent base with a holding fit, characterized in that said impression member as well as having an impression portion on the face remote from the transparent base supports a facsimile of the impression viewable through the said transparent base in substantial register with the said impression; the impression member being resilient and the side portions engaging the base are a pair of resilient inwardly slanted edges having portions complementary in shape to a pair of slanted edge portions formed on the base, said impression member normally being planar when engaged with the base, the member carrying a facsimile of the impression being engageable with the base by a snap action.

* * * * *